US007814885B2

(12) United States Patent
Mitobe et al.

(10) Patent No.: US 7,814,885 B2
(45) Date of Patent: Oct. 19, 2010

(54) FAST IDLE AIR AMOUNT CONTROL SYSTEM IN SIDE STAND-EQUIPPED TWO-WHEELED MOTOR VEHICLE

(75) Inventors: Masaaki Mitobe, Miyagi (JP); Michio Onuma, Miyagi (JP)

(73) Assignee: Keihin Corporation, Tokyo (JP)

( * ) Notice: Subject to any disclaimer, the term of this patent is extended or adjusted under 35 U.S.C. 154(b) by 118 days.

(21) Appl. No.: 11/919,673

(22) PCT Filed: May 22, 2006

(86) PCT No.: PCT/JP2006/310109

§ 371 (c)(1),
(2), (4) Date: Dec. 16, 2008

(87) PCT Pub. No.: WO2006/123819

PCT Pub. Date: Nov. 23, 2006

(65) Prior Publication Data

US 2009/0301433 A1 Dec. 10, 2009

(30) Foreign Application Priority Data

May 20, 2005 (JP) ..... 2005-147705

(51) Int. Cl.
*F02D 41/08* (2006.01)

(52) U.S. Cl. ..... 123/339.27; 123/339.23

(58) Field of Classification Search ..... 123/339.1, 123/339.14, 339.23, 339.27
See application file for complete search history.

(56) References Cited

U.S. PATENT DOCUMENTS

| | | | | |
|---|---|---|---|---|
| 5,439,585 | A * | 8/1995 | Arakawa | 210/167.04 |
| 5,762,158 | A * | 6/1998 | Sumner, Jr. | 180/219 |
| 6,435,155 | B2 * | 8/2002 | Kawamoto | 123/196 A |
| 6,446,599 | B1 * | 9/2002 | Nakayasu | 123/339.23 |
| 7,325,531 | B2 * | 2/2008 | Suzuki | 123/336 |
| 2001/0015191 | A1 * | 8/2001 | Kawamoto | 123/196 R |

FOREIGN PATENT DOCUMENTS

| | | | |
|---|---|---|---|
| JP | 4-159454 | A | 6/1992 |
| JP | 2002-349396 | A | 12/2002 |
| JP | 2003-90216 | A | 3/2003 |
| JP | 2003-129924 | A | 5/2003 |
| JP | 2005-113718 | A | 4/2005 |

* cited by examiner

*Primary Examiner*—Erick Solis
(74) *Attorney, Agent, or Firm*—Arent Fox LLP

(57) ABSTRACT

A fast idle air amount control system in a side stand-equipped two-wheeled motor vehicle is provided in which a bypass control valve (10) is arranged so that an axis (Y) of the bypass control valve (10) is substantially horizontal along the lateral direction of a two-wheeled motor vehicle (M) when the two-wheeled motor vehicle (M) is in an upright state and slopes downward toward a side stand (41) side when the two-wheeled motor vehicle (M) is put in an inclined parked state by standing it on the side stand (41), and an actuator (25), which is electrically operated, is coupled to an end part of the bypass control valve (10) on a side opposite to the side stand (41). This enables a fast idle air amount control system in a two-wheeled motor vehicle to be provided in which the actuator is formed as an electrically operated type and it is possible to easily prevent water droplets generated in a bypass from entering the electrically operated actuator even when the two-wheeled motor vehicle is put in an inclined parked state by standing it on the side stand.

14 Claims, 9 Drawing Sheets

FAST IDLE AIR AMOUNT CONTROL SYSTEM IN SIDE STAND-EQUIPPED TWO-WHEELED MOTOR VEHICLE

CROSS-REFERENCE TO RELATED APPLICATION

This application is a National Stage entry of International Application No. PCT/JP2006/310109, filed May 22, 2006, the entire specification, claims, and drawings of which are incorporated herewith by reference.

TECHNICAL FIELD

The present invention relates to an improvement of a fast idle air amount control system in a side stand-equipped two-wheeled motor vehicle, in which a bypass control valve for controlling the amount of fast idle air supplied to an engine mounted on a vehicle body is connected to a throttle body of the engine, and an actuator for operating the bypass control valve is coupled to the bypass control valve.

BACKGROUND ART

Such a fast idle air amount control system in a side stand-equipped two-wheeled motor vehicle is already known, as disclosed in Patent Publication 1.

Patent Publication 1: Japanese Patent Application Laid-open No. 2003-129924

DISCLOSURE OF INVENTION

Problems to be Solved by the Invention

In the fast idle air amount control system in a two-wheeled motor vehicle disclosed in Patent Publication 1 above, the actuator is formed as a wax type in which the bypass control valve is operated using wax, which expands in response to an increase in engine temperature. However, in order to finely operate the bypass control valve according to various running conditions of the engine, the use of an electrically operated actuator is desirable.

It is therefore an object of the present invention to provide a fast idle air amount control system in a side stand-equipped two-wheeled motor vehicle in which the actuator is formed as an electrically operated type; this electrically operated actuator is provided in a well-organized arrangement, thus making the surroundings of a throttle body compact, and making it possible to easily prevent water droplets generated by condensation in a bypass from entering the electrically operated actuator even when the two-wheeled motor vehicle is put in an inclined parked state by standing it on a side stand.

Means for Solving the Problems

In order to attain the above object, according to a first aspect of the present invention, there is provided a fast idle air amount control system in a side stand-equipped two-wheeled motor vehicle, in which a bypass control valve for controlling the amount of fast idle air supplied to an engine mounted on a vehicle body is connected to a throttle body of the engine, and an actuator for operating the bypass control valve is coupled to the bypass control valve, characterized in that the bypass control valve is arranged so that an axis of the bypass control valve is substantially horizontal along the lateral direction of a two-wheeled motor vehicle when the two-wheeled motor vehicle is in an upright state and slopes downward toward a side stand side when the two-wheeled motor vehicle is put in an inclined parked state by standing the two-wheeled motor vehicle on the side stand, and the actuator, which is electrically operated, is coupled to an end part of the bypass control valve on a side opposite to the side stand.

In addition, according to a second aspect of the present invention, in addition to the first aspect, the bypass control valve and the electrically operated actuator are mounted on the throttle body.

Further, according to a third aspect of the present invention, in addition to the second aspect, the bypass control valve is disposed so that the axis thereof is parallel to an axis of a valve shaft of a throttle valve supported on the throttle body.

Furthermore, according to a fourth aspect of the present invention, in addition to the second or third aspect, the bypass control valve is formed from a valve chamber formed in a control block joined to one side face of the throttle body and a valve body housed within the valve chamber.

Furthermore, according to a fifth aspect of the present invention, in addition to any one of the first to fourth aspects, the bypass control valve and the electrically operated actuator are disposed between the throttle body and a cylinder head of the engine on which the throttle body is mounted.

Furthermore, according to a sixth aspect of the present invention, in addition to any one of the first to fifth aspects, a throttle body is provided for each cylinder of a multicylinder engine.

Effects of the Invention

In accordance with the first aspect of the present invention, since the bypass control and the electrically operated actuator are arranged so that they are substantially horizontal along the lateral direction when the two-wheeled motor vehicle is in an upright state, it is possible to arrange the bypass control valve and the electrically operated actuator compactly on one side of the throttle body.

Moreover, since the bypass control valve and the electrically operated actuator are inclined with the electrically operated actuator facing upward when the two-wheeled motor vehicle is put in an inclined parked state by standing it on the side stand, even if the inclined state continues for a long period of time, water droplets generated by condensation on an inner face of the bypass or the valve chamber flow down in a direction opposite from the electrically operated actuator. It is therefore possible to easily prevent the water droplets from entering the interior of the electrically operated actuator even when the pressure of the interior of the electrically operated actuator, which has operated and generated heat during running of the engine, reduces due to the stoppage of the operation, thereby enhancing the durability of the electrically operated actuator.

Furthermore, in accordance with the second aspect of the present invention, since the bypass control valve and the electrically operated actuator are mounted on the throttle body, the need for a bracket exclusively used for mounting the bypass control valve and the electrically operated actuator is eliminated, and it is possible to simplify the structure for mounting the bypass control valve and the electrically operated actuator and consequently reduce the cost of the fast idle air amount control system.

Moreover, in accordance with the third aspect of the present invention, since the bypass control valve is disposed so that its axis is parallel to the axis of the valve shaft of the throttle valve supported on the throttle body, it is possible to arrange the valve shaft and the bypass control valve in proximity to each other, thus making the assembly of the throttle body and the bypass control valve compact.

Furthermore, in accordance with the fourth aspect of the present invention, since the throttle body and the control block, on which the bypass control valve is mounted, are formed as separate bodies, the bypass has a divided form, and it becomes easy to form these bypasses. Moreover, since it is possible to assemble a subassembly of the control block and the bypass control valve separately from the throttle body side, the ease of assembly is good, and since the control block can be separated from the throttle body, the ease of maintenance of the bypass control valve, etc. is also good.

Moreover, in accordance with the fifth aspect of the present invention, a dead space between the throttle body and the cylinder head can be utilized effectively as a space for installing the bypass control valve and the actuator, and it is possible to avoid interference of the bypass control valve and the actuator with other equipment.

Furthermore, in accordance with the sixth aspect of the present invention, since the throttle body is provided for each cylinder of the multicylinder engine, it is possible to make the intake air of each cylinder uniform, thus contributing to an improvement of the engine output performance.

EXPLANATION OF REFERENCE NUMERALS AND SYMBOLS

Figure 1:
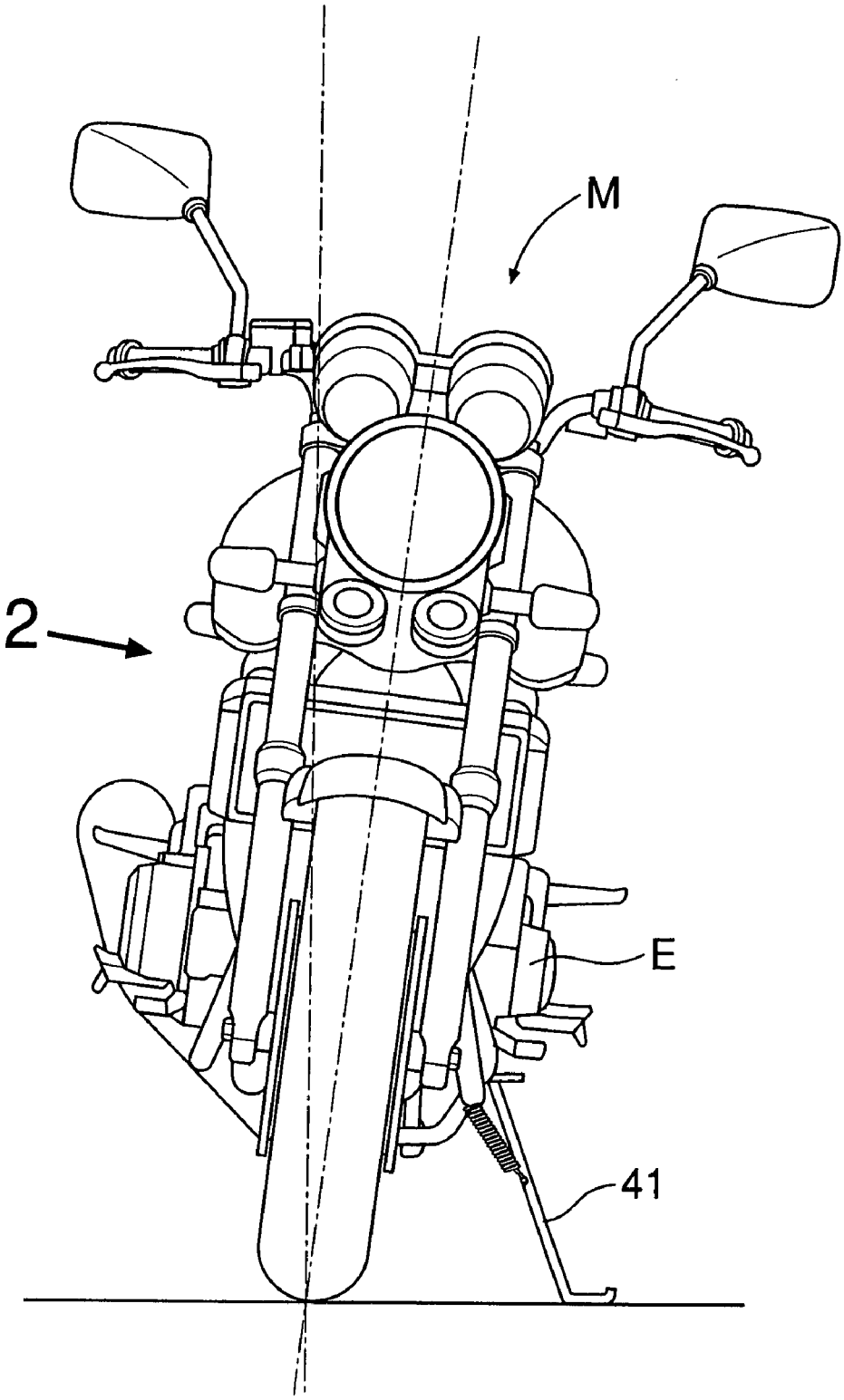
FIG. 1 is a front view showing a two-wheeled motor vehicle related to an embodiment of the present invention in a state in which it is standing on a side stand (first embodiment).

B Axis of valve shaft of throttle valve
E Engine
Y Axis of bypass control valve
$\mathbf{1}_1$, $\mathbf{1}_2$ Throttle body
$\mathbf{2}_1$, $\mathbf{2}_2$ Intake path
$\mathbf{4}_1$, $\mathbf{4}_2$ Valve shaft
$\mathbf{5}_1$, $\mathbf{5}_2$ Throttle valve
10 Bypass control valve
12 Bypass
12*a* Bypass upstream passage
$\mathbf{12}b_1$, $\mathbf{12}b_2$ Bypass downstream passage
18 Valve chamber
25 Electric actuator
26 Valve body
40 Cylinder head
41 Side stand

BEST MODE FOR CARRYING OUT THE INVENTION

A mode for carrying out the present invention is explained below by reference to a preferred embodiment of the present invention shown in the attached drawings.

Embodiment 1

Figure 2:
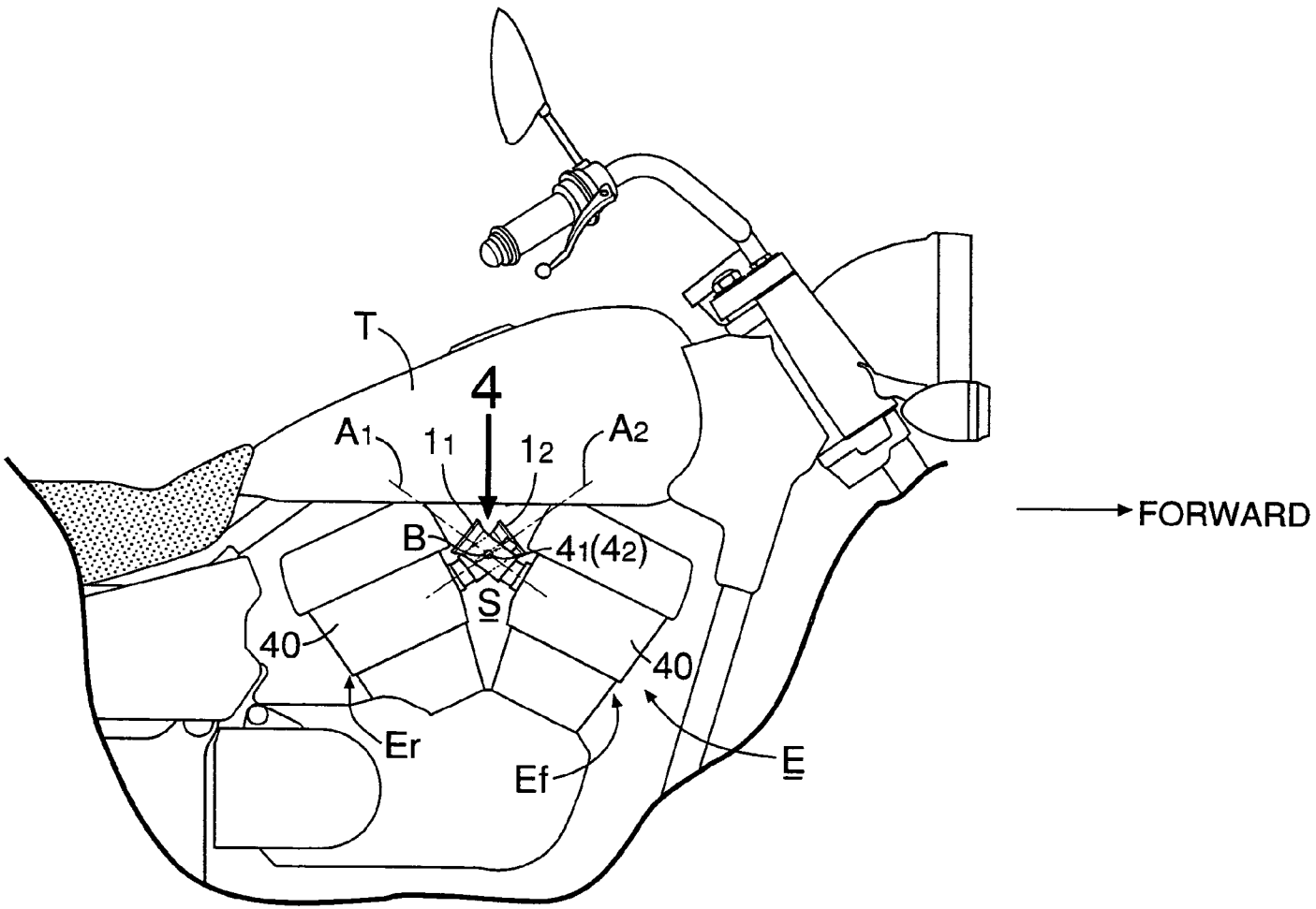
FIG. 2 is a view from arrow 2 in FIG. 1 (first embodiment).

In FIG. 1 and FIG. 2, mounted on a vehicle body of a two-wheeled motor vehicle M between a front wheel and a rear wheel are an engine E and a fuel tank T positioned immediately thereabove, and installed beneath the left side of the vehicle body is a side stand 41. This side stand 41 pivots between a horizontal retracted position and a working position in which it projects downward, and in the working position the two-wheeled motor vehicle M can be parked while being inclined toward the side stand 41 side with the front wheel and the rear wheel in contact with the ground as shown in FIG. 1.

The engine E is formed as a V type equipped with a pair of front and rear banks Ef and Er, a first throttle body $\mathbf{1}_1$ is mounted on a rear face of a cylinder head 40 of the front bank Ef, and a second throttle body $\mathbf{1}_2$ is mounted on a front face of a cylinder head 40 of the rear bank Er. The first and second throttle bodies $\mathbf{1}_1$ and $\mathbf{1}_2$ are thus arranged in the lateral direction of the vehicle and are disposed in a V-shaped space S interposed between the front and rear banks Ef and Er.

The first and second throttle bodies $\mathbf{1}_1$ and $\mathbf{1}_2$ are equipped with intake paths $\mathbf{2}_1$ and $\mathbf{2}_2$ communicating with intake ports of the corresponding cylinder heads 40, the intake paths $\mathbf{2}_1$ and $\mathbf{2}_2$ being disposed so that their axes $A_1$ and $A_2$ intersect in directions forming an X-shape when viewed from the side of the two-wheeled motor vehicle M.

Figure 3:
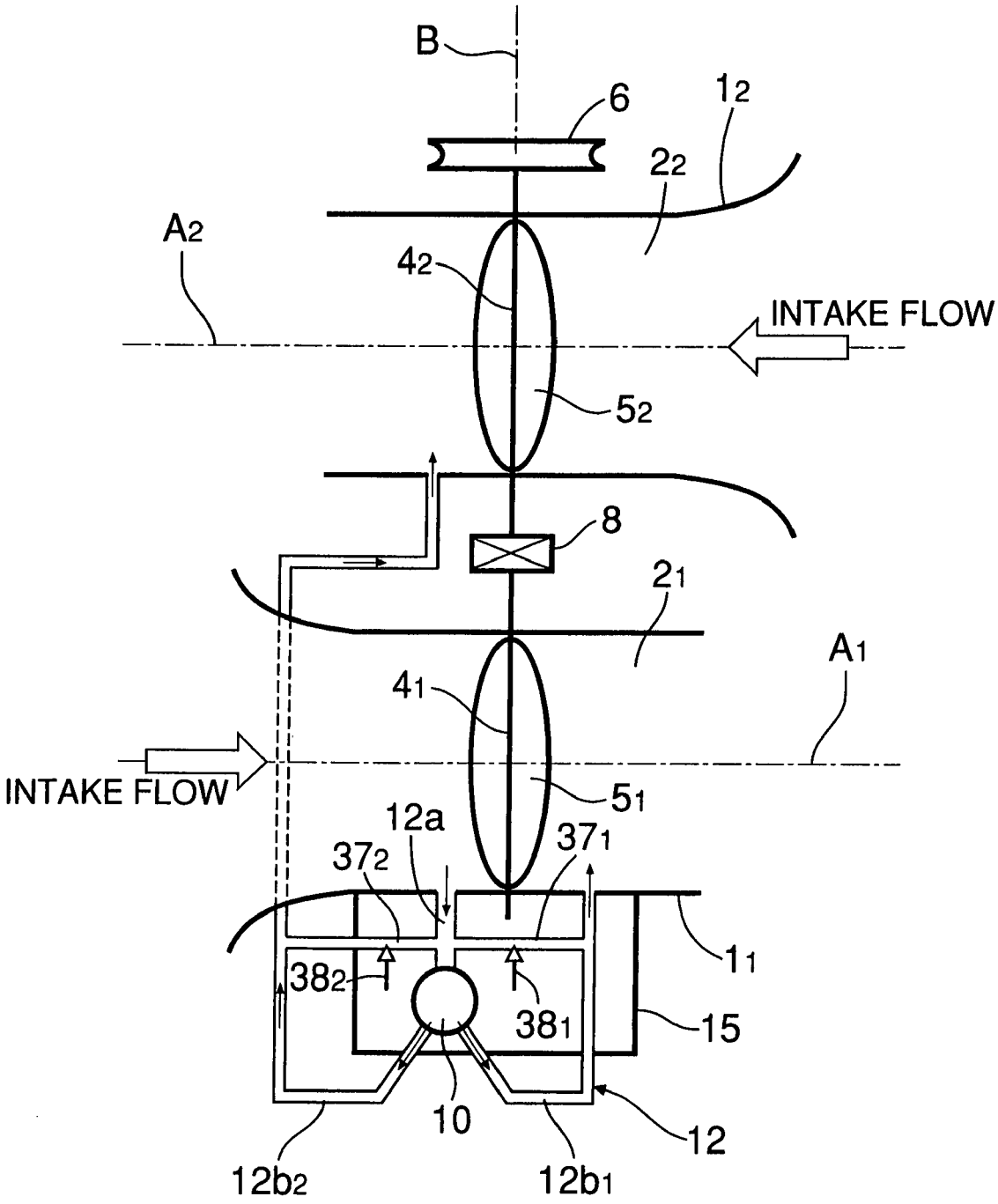
FIG. 3 is a schematic diagram of an engine intake system that includes a fast idle air amount control system of the two-wheeled motor vehicle (first embodiment).

As shown in FIG. 3, the first and second throttle bodies $\mathbf{1}_1$ and $\mathbf{1}_2$ have the intake paths $\mathbf{2}_1$ and $\mathbf{2}_2$ communicating with intake ports of the front and rear banks Ef and Er, and butterfly type throttle valves $\mathbf{5}_1$ and $\mathbf{5}_2$ for opening and closing these intake paths $\mathbf{2}_1$ and $\mathbf{2}_2$ are mounted on valve shafts $\mathbf{4}_1$ and $\mathbf{4}_2$ respectively. These valve shafts $\mathbf{4}_1$ and $\mathbf{4}_2$ are rotatably supported on the first and second throttle bodies $\mathbf{1}_1$ and $\mathbf{1}_2$ respectively, are arranged on the same axis B as each other, and are integrally coupled via a synchronizing system 8 for making phases of the two throttle valves $\mathbf{5}_1$ and $\mathbf{5}_2$ coincide with each other; moreover, a throttle drum 6 is mounted on the outer end of one valve shaft $\mathbf{4}_2$, and pivoting the throttle drum 6 via a throttle wire (not illustrated) enables the two throttle valves $\mathbf{5}_1$ and $\mathbf{5}_2$ to be opened and closed in synchronism with each other. The first and second throttle bodies $\mathbf{1}_1$ and $\mathbf{1}_2$ are arranged so that, when the two-wheeled motor vehicle M is upright, the valve shafts $\mathbf{4}_1$ and $\mathbf{4}_2$ have a substantially horizontal attitude along the lateral direction.

Furthermore, the intake paths $\mathbf{2}_1$ and $\mathbf{2}_2$ of the first and second throttle bodies $\mathbf{1}_1$ and $\mathbf{1}_2$ are connected to a bypass 12 for supplying fast idle air during warming up of the engine E. This bypass 12 is formed from a common bypass upstream passage 12*a* having the upstream end connected to the intake path $\mathbf{2}_1$ upstream of the throttle valve $\mathbf{5}_1$ of the first throttle body $\mathbf{1}_1$ and first and second bypass downstream passages $\mathbf{12}b_1$ and $\mathbf{12}b_2$ having their downstream ends connected to the intake paths $\mathbf{2}_1$ and $\mathbf{2}_2$ downstream of the throttle valves $\mathbf{5}_1$ and $\mathbf{5}_2$ of the first and second throttle bodies $\mathbf{1}_1$ and $\mathbf{1}_2$. The downstream end of the bypass upstream passage 12*a* and upstream ends of the first and second bypass downstream passages $\mathbf{12}b_1$ and $\mathbf{12}b_2$ are connected via a bypass control valve 10, and operation of the bypass control valve 10 controls the degree of communication between the first and second bypass downstream passages $12b_1$ and $12b_2$ and the bypass upstream passage 12*a*, that is, the amount of fast idle air.

First and second idle air passages $37_1$, and $37_2$ bypassing the bypass control valve 10 are connected between the bypass upstream passage 12*a* and each of the first and second bypass downstream passage $12b_1$ and $12b_2$, and a pair of idle adjustment screws $38_1$, and $38_2$ are provided in middle sections of these idle air passages $37_1$, and $37_2$, the idle adjustment screws $38_1$ and $38_2$ adjusting the passage areas thereof.

The arrangement of the first and second throttle bodies $1_1$ and $1_2$, the bypass upstream passage 12*a*, the first and second bypass downstream passages $12b_1$ and $12b_2$, and the bypass control valve 10 is explained in detail by reference to FIG. 4 to FIG. 9.

Figure 4:
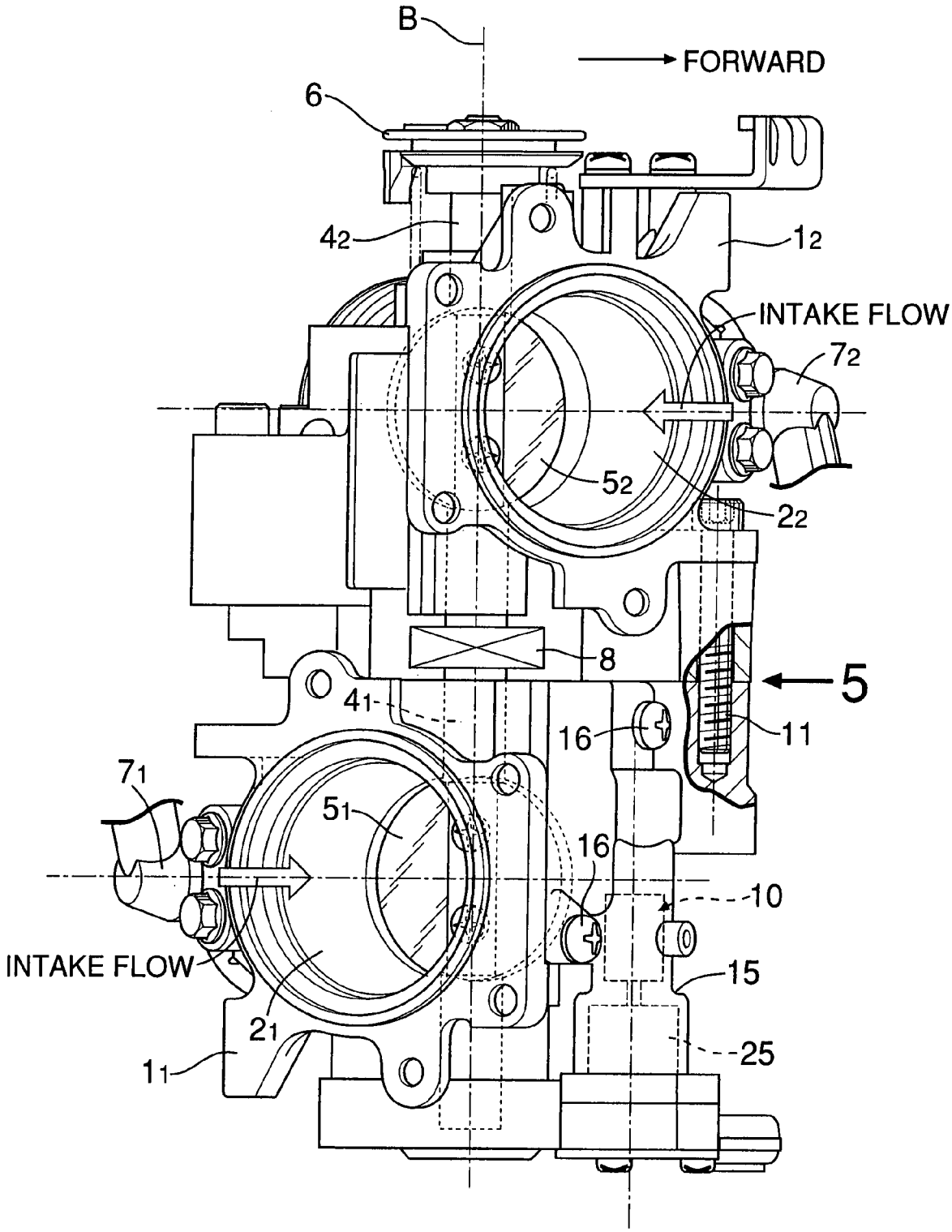
FIG. 4 is a plan view (enlarged view from arrow 4 in FIG. 2) of the intake system (first embodiment).
Figure 5:
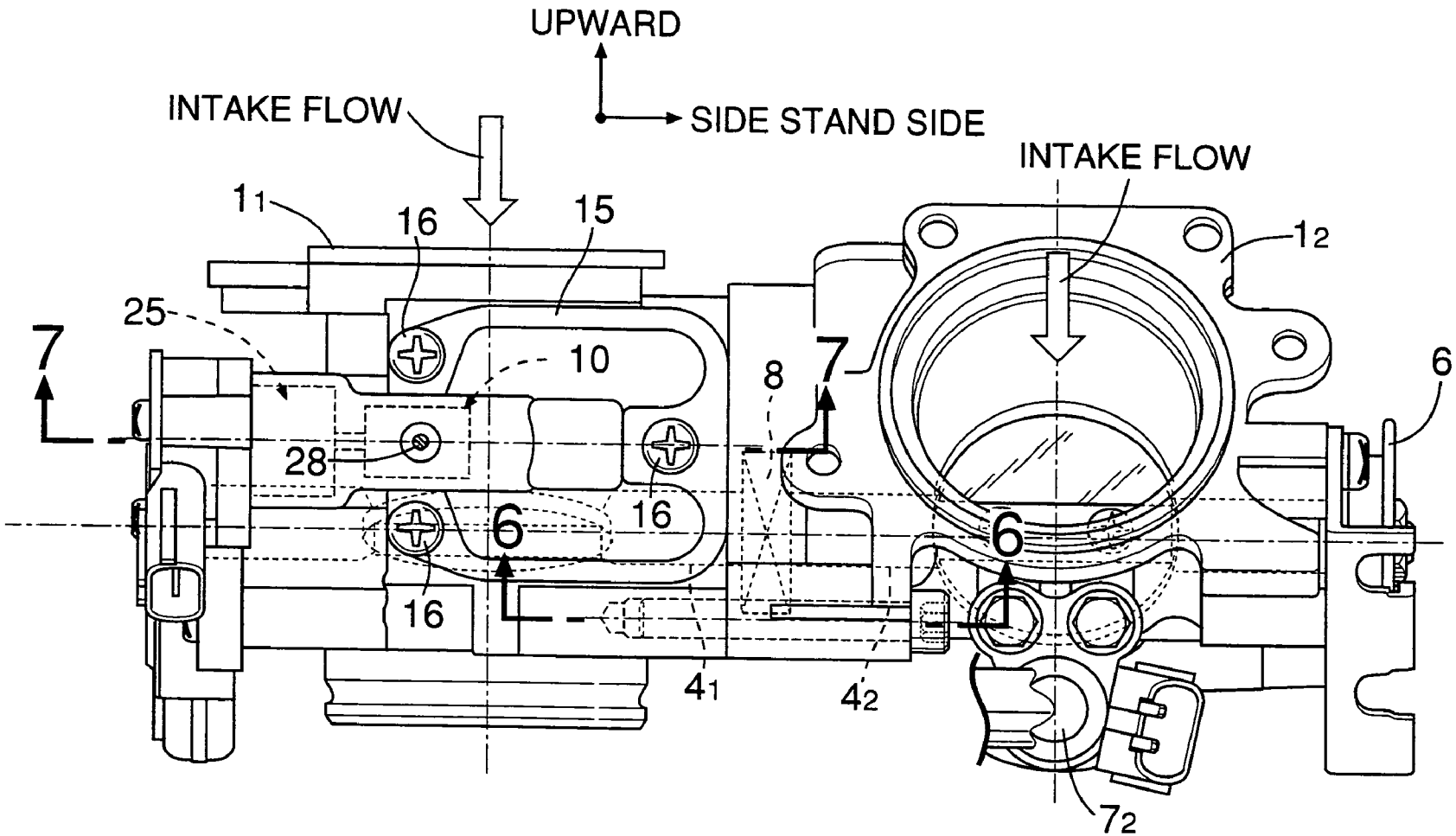
FIG. 5 is a view from arrow 5 in FIG. 4 (first embodiment).
Figure 6:
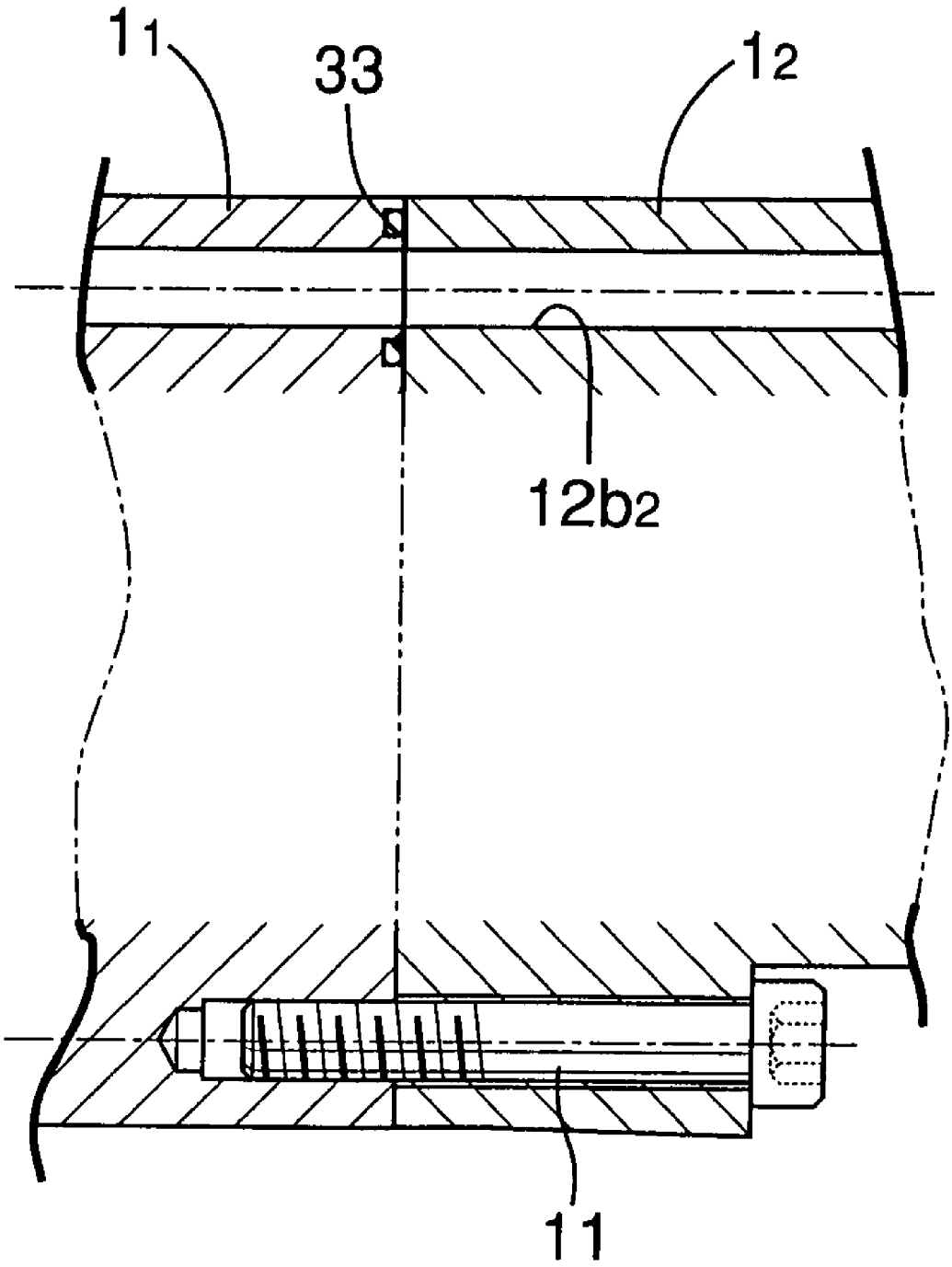
FIG. 6 is a sectional view along line 6-6 in FIG. 5 (first embodiment).

As shown in FIG. 4 to FIG. 6, the first and second throttle bodies $1_1$ and $1_2$ abut against each other via adjacent side faces and are joined by means of a plurality of coupling bolts 11 (one thereof being shown in FIG. 6).

Figure 7:
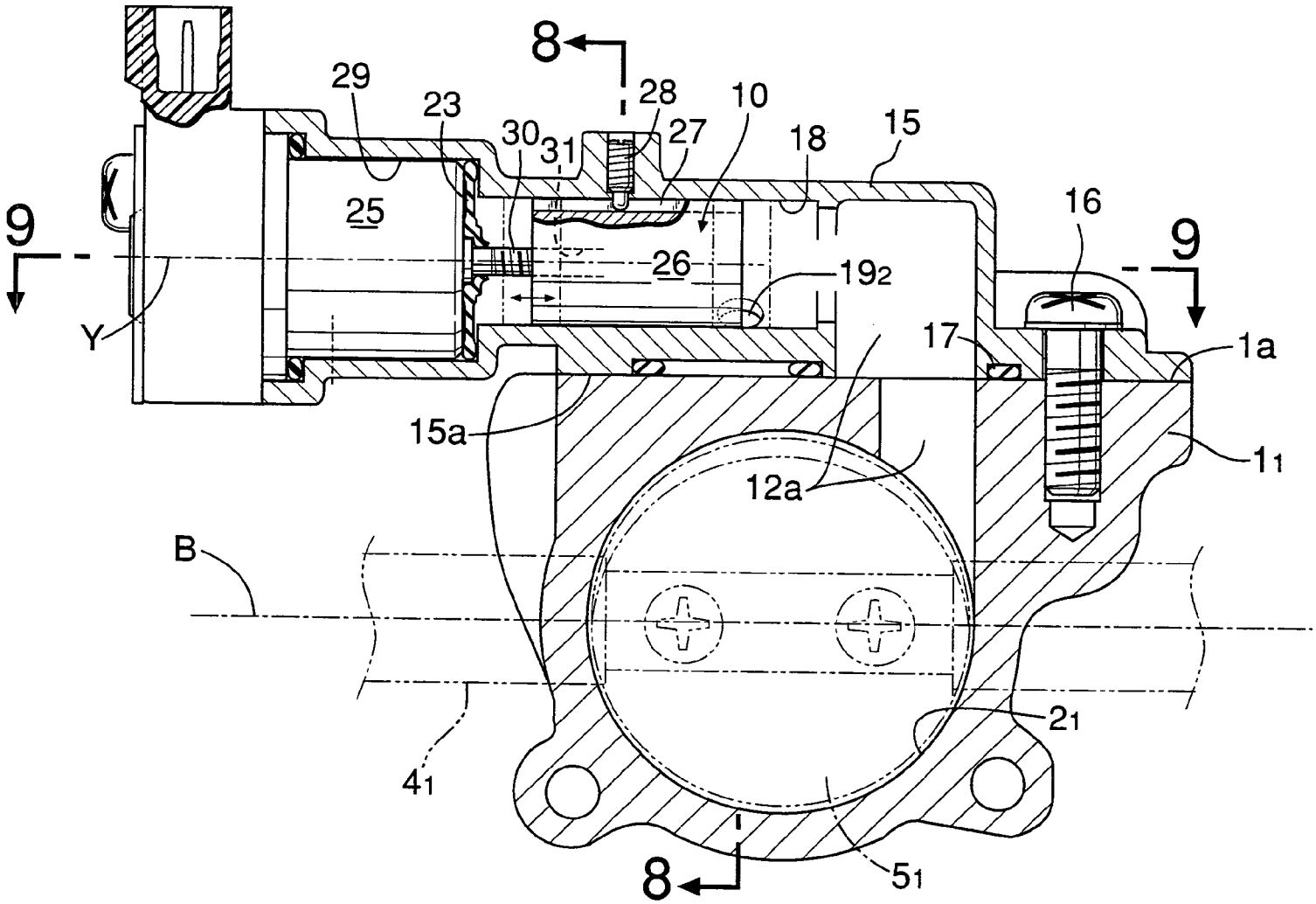
FIG. 7 is a sectional view along line 7-7 in FIG. 5 (first embodiment).
Figure 8:
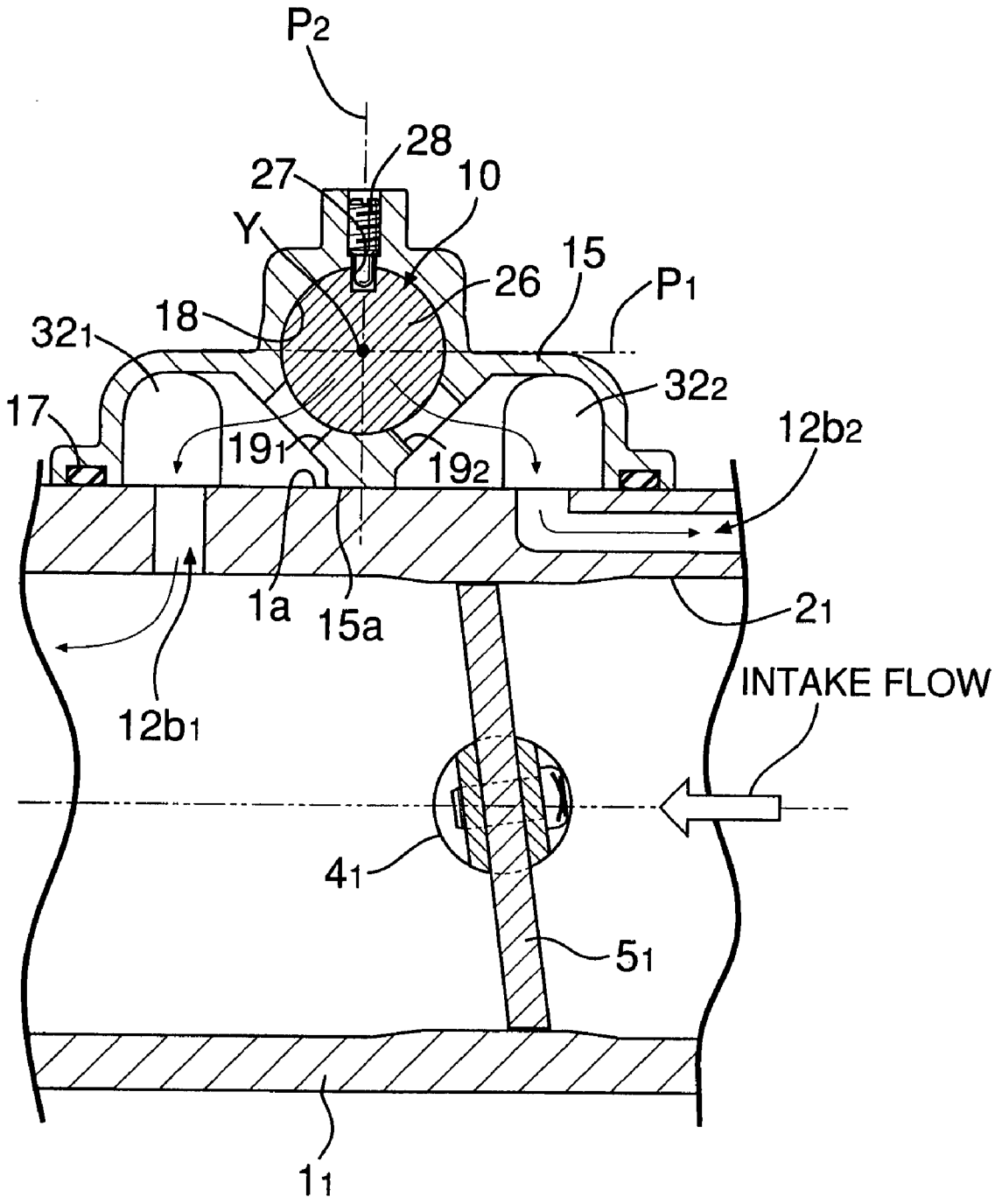
FIG. 8 is a sectional view along line 8-8 in FIG. 7 (first embodiment).
Figure 9:
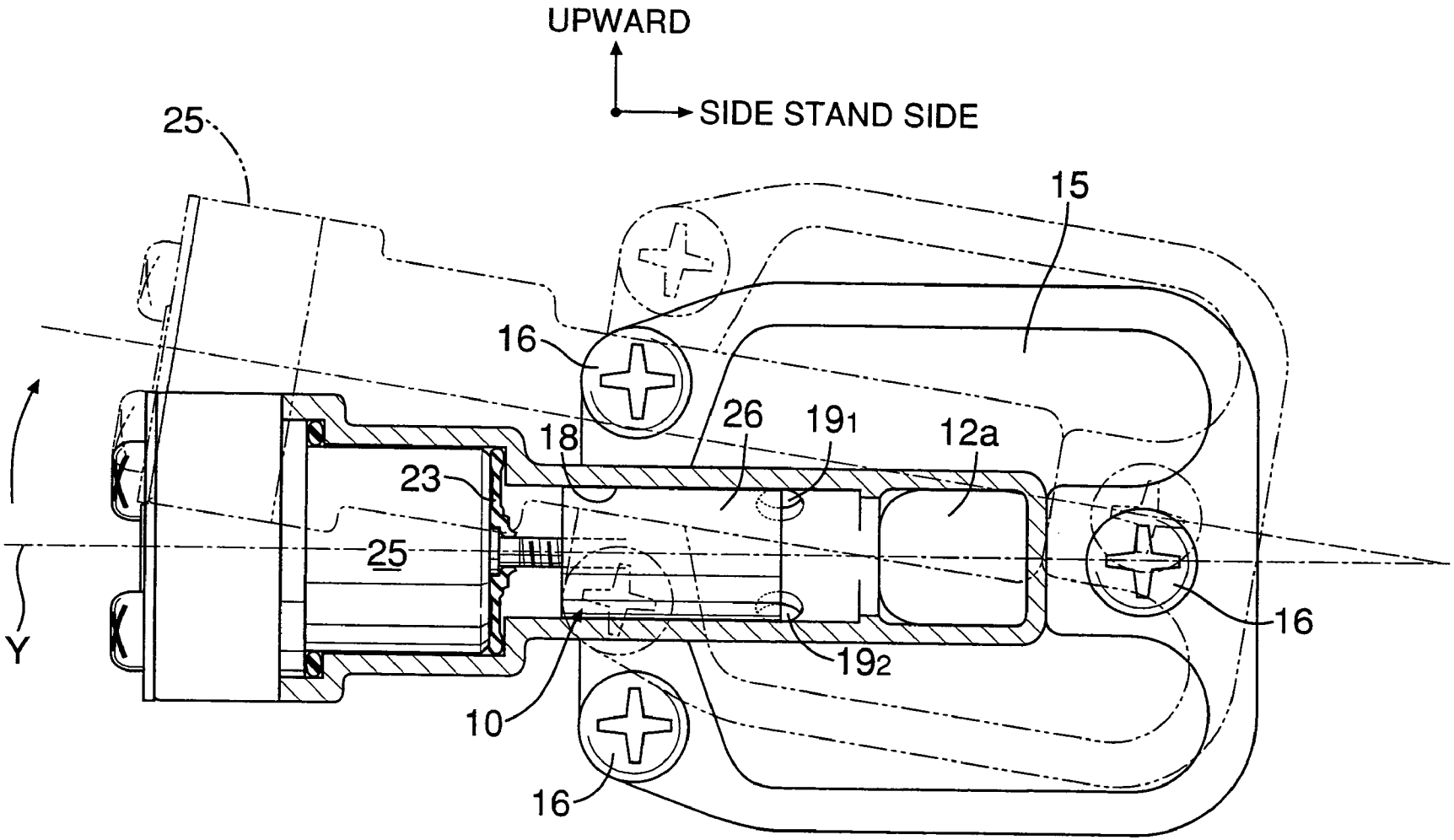
FIG. 9 is a sectional view along line 9-9 in FIG. 7 (first embodiment).

As clearly shown in FIG. 7 to FIG. 9, a control block 15 is detachably joined by means of a plurality of bolts 16 to a front face, facing the cylinder head 40 of the corresponding front bank Ef, of the first throttle body $1_1$ with a seal 17 interposed therebetween; this control block 15 is provided with a cylindrical valve chamber 18 parallel to the valve shaft $4_1$, and the bypass upstream passage 12*a*, which provides a connection between one end face of the valve chamber 18 on the side stand 41 side and the intake path $2_1$ of the first throttle body $1_1$ upstream of the throttle valve $5_1$, is provided by molding or boring from the first throttle body $1_1$ to the control block 15. A pair of distribution chambers $32_1$, and $32_2$ arranged around the valve chamber 18 are provided on a face 1*a* via which the control block 15 is joined to the first throttle body $1_1$, and these distribution chambers $32_1$, and $32_2$ communicate with the interior of the valve chamber 18 via a pair of metering holes $19_1$ and $19_2$ respectively. These distribution chambers $32_1$ and $32_2$ and the metering holes $19_1$ and $19_2$ form upstream end parts of the first and second bypass downstream passages $12b_1$ and $12b_2$.

On the other hand, a downstream side portion of the first bypass downstream passage $12b_1$ is provided by molding or boring in the first throttle body $1_1$, the first bypass downstream passage $12b_1$ providing a connection between the first distribution chamber $32_1$ and the intake path $2_1$ downstream of the throttle valve $5_1$, and a downstream side portion of the second bypass downstream passage $12b_2$ is provided by molding or boring in the first and second throttle bodies $1_1$ and $1_2$, the second bypass downstream passage $12b_2$ providing a connection between the second distribution chamber $32_2$ and the intake path $2_2$ downstream of the second throttle valve 52. Since this second bypass downstream passage $12b_2$ passes through faces via which the first and second throttle bodies $1_1$ and $1_2$ are joined, as shown in FIG. 6, a seal 33 is disposed between the faces via which they are joined, the seal 33 surrounding the second bypass downstream passage $12b_2$ and blocking it from the outside air.

Referring again to FIG. 7 to FIG. 9, a piston-shaped valve body 26 is slidably fitted into the valve chamber 18 from a side opposite to the side stand 41, the valve body 26 adjusting the degree of opening of the metering holes $19_1$, and $19_2$ from fully closed state to fully open state, and in this arrangement, in order to prevent the valve body 26 from rotating, a keyway 27 is provided in a side face of the valve body 26, and a key 28 for slidably engaging with the keyway 27 is mounted on the control block 15. An electrically operated actuator 25 (hereinafter, simply called an electric actuator) for opening and closing the valve body 26 is fitted into a mounting hole 29 formed in the control block 15 so as to communicate with the other end of the valve chamber 18 on the side opposite to the side stand 41, and is secured to the control block 15 by a bolt. This electric actuator 25 has a rotational output shaft 30, which is coaxial with the valve body 26 and is screwed into a threaded hole 31 in a central part of the valve body 26, and the valve body 26 can be made to slide laterally by rotating the output shaft 30 forward or backward, thus enabling the pair of metering holes $19_1$ and $19_2$ to be equally opened and closed simultaneously. A plate-shaped seal 23 in intimate contact with the outer periphery of the output shaft 30 is disposed between a lower end face of the electric actuator 25 and a bottom face of the mounting hole 29. The bypass control valve 10 is thus formed from the valve chamber 18 and the valve body 26.

In this way, the bypass control valve 10 and the electric actuator 25 are arranged between the first throttle body $1_1$ and the cylinder head 40 of the front bank Ef facing the first throttle body $1_1$ so that, in the same way as for the valve shafts $4_1$ and $4_2$, an axis Y of the bypass control valve 10 is substantially horizontal along the lateral direction of the two-wheeled motor vehicle M when the two-wheeled motor vehicle M is in an upright state and it has a downward slope toward the side stand 41 side as shown by a chain line in FIG. 9 when the two-wheeled motor vehicle M is put in an inclined parked state by standing it on the side stand 41. Furthermore, since the electric actuator 25 is coupled to an end part of the bypass control valve 10 on the side opposite to the side stand 41, it occupies a position above the bypass control valve 10 when the two-wheeled motor vehicle M is put in the inclined parked state by standing it on the side stand 41.

The metering holes $19_1$ and $19_2$, which are at the upstream ends of the first and second bypass downstream passages $12b_1$ and $12b_2$ and open into the cylindrical valve chamber 18, are disposed to one side of a plane P1 containing the axis Y of the valve chamber 18. The key 28 for preventing rotation of the valve body 26 is disposed on a second plane P2 containing the axis Y and running through the midpoint between the two metering holes $19_1$ and $19_2$.

As shown in FIG. 4 and FIG. 5, fuel injection valves $7_1$ and $7_2$ are fitted into the first and second throttle bodies $1_1$ and $1_2$, the fuel injection valves $7_1$ and $7_2$ injecting fuel into the engine intake ports via the intake paths $2_1$ and $2_2$ downstream of the throttle valves $5_1$, and $5_2$.

The operation of this embodiment is now explained.

Since during warming up of the engine a control system (not illustrated) supplies to the electric actuator 25 of the bypass control valve 10 a current corresponding to, for example, the engine temperature so as to operate the electric actuator 25, when the engine temperature is low, the valve body 26 is pulled by a large amount so as to adjust the degree of opening of the metering holes $19_1$ and $19_2$ to a large value. In a state in which the throttle valves $5_1$ and $5_2$ are fully closed, the amount of fast idle air supplied to the engine through the bypasses $12_1$ and $12_2$ is controlled so as to be relatively large by the metering holes $19_1$ and $19_2$, at the same time fuel is injected from the fuel injection valves $7_1$ and $7_2$ toward the downstream side of the intake paths $2_1$ and $2_2$ so as to correspond to the amount of operation of the electric actuator 25, and the engine receives a supply of the fast idle air and the fuel, thus maintaining a fast idling rotational speed so as to accelerate the warming up.

Since, when the engine temperature increases as the warming up progresses, the electric actuator 25 moves the valve body 26 accordingly so as to decrease the degree of opening of the metering holes $19_1$ and $19_2$, the fast idle air supplied to the engine via the bypasses $12_1$ and $12_2$ is reduced, and the engine fast idling rotational speed decreases. Such control of the fast idling rotational speed is carried out finely and appropriately since the electric actuator 25 has particularly high responsiveness to a control signal.

Since, when the engine temperature reaches a predetermined high temperature, the electric actuator 25 lowers the valve body 26 to a fully closed state so as to fully block the bypasses $\mathbf{12}_1$ and $\mathbf{12}_2$, in a state in which the throttle valves $\mathbf{5}_1$ and $\mathbf{5}_2$ of the intake paths $\mathbf{2}_1$ and $\mathbf{2}_2$ are closed, a minimum idle air is supplied to the engine only via the idle air passages $\mathbf{37}_1$ and $\mathbf{37}_2$, and the engine is controlled at a normal idle rotational speed. In this arrangement, the amounts of idle air flowing through the idle air passages $\mathbf{37}_1$, and $\mathbf{37}_2$ can be individually adjusted by adjusting the idle adjustment screws $\mathbf{38}_1$ and $\mathbf{38}_2$ forward and backward.

Since, during fast idling when the valve body 26 of the bypass control valve 10 adjusts the degree of opening of the metering holes $\mathbf{19}_1$ and $\mathbf{19}_2$, the engine intake negative pressure acts alternately on the side face of the valve body 26 via the pair of bypass downstream passages $\mathbf{12}b_1$ and $\mathbf{12}b_2$, that is, the metering holes $\mathbf{19}_1$, and $\mathbf{19}_2$, the valve body 26 is alternately drawn toward the metering holes $\mathbf{19}_1$ and $\mathbf{19}_2$ side within the cylindrical valve chamber 18, but since these metering holes $\mathbf{19}_1$ and $\mathbf{19}_2$ are disposed to one side of the plane P1 containing the axis Y of the valve chamber 18, the valve body 26 is drawn by the above negative pressure toward a middle section of the inner face of the valve chamber 18 between the metering holes $\mathbf{19}_1$ and $\mathbf{19}_2$, thus suppressing vibration. As a result, there is hardly any change in the gap between the valve body 26 and the inner face of the valve chamber 18 on the metering holes $\mathbf{19}_1$ and $\mathbf{19}_2$ side, the precision of control of the degree of opening of the metering holes $\mathbf{19}_1$, and $\mathbf{19}_2$ by the valve body 26 is enhanced, the amount of fast idle air supplied to each engine cylinder is made uniform, and it is possible to stabilize the fast idle rotational speed and reduce harmful components in the exhaust.

On the other hand, since the key 28 and the keyway 27 for preventing the valve body 26 from rotating are disposed on the second plane P2 containing the axis Y and running through the midpoint between the two metering holes $\mathbf{19}_1$ and $\mathbf{19}_2$, even when the valve body 26 is drawn by the negative pressure toward the middle section of the inner face of the valve chamber 18 between the metering holes $\mathbf{19}_1$ and $\mathbf{19}_2$, an undue side pressure does not act between the key 28 and the keyway 27, and the key 28 and the keyway 27 therefore do not interfere with sliding of the valve body 26, thereby ensuring that the valve body 26 can be smoothly moved by the electric actuator 25.

Furthermore, since the bypass control valve 10 and the electric actuator 25 are arranged between the first throttle body $\mathbf{1}_1$ and the cylinder head 40 of the front bank Ef facing the first throttle body $\mathbf{1}_1$ so that, in the same way as for the valve shafts $\mathbf{4}_1$ and $\mathbf{4}_2$, the axis Y of the bypass control valve 10 is substantially horizontal along the lateral direction of the two-wheeled motor vehicle M when the two-wheeled motor vehicle M is in an upright state, the bypass control valve 10 and the electric actuator 25 do not form a projection around the first throttle body $\mathbf{1}_1$, the assembly of the first throttle body $\mathbf{1}_1$, the bypass control valve 10, and the electric actuator 25 can be made compact, and the assembly can easily be arranged in a very confined space around the engine E of the two-wheeled motor vehicle M.

Moreover, when the two-wheeled motor vehicle M is put in an inclined parked state (see FIG. 1) by standing it on the side stand 41, as shown by the chain line in FIG. 9, the bypass control valve 10 and the electric actuator 25 are in an inclined state with the electric actuator 25 toward the top and occupying a position above the bypass control valve 10, and even if the inclined state lasts for a long period of time, water droplets generated by condensation on an inner face of the bypass 12 or the valve chamber 18 flow downward in a direction opposite to the electric actuator 25. Therefore, even if the pressure of the interior of the electric actuator 25, which has operated and generated heat during running of the engine E, reduces due to the stoppage of the operation and an end part of the seal 23 flexes, it is possible to prevent the water droplets from entering the interior of the electric actuator 25, thus enhancing the durability of the electric actuator 25.

Furthermore, since the bypass control valve 10 and the electric actuator 25 are mounted on the first throttle body $\mathbf{1}_1$, the need for a bracket exclusively used for mounting the bypass control valve 10 and the electric actuator 25 is eliminated, and it is possible to simplify the structure for mounting the bypass control valve 10 and the electric actuator 25 and consequently reduce the cost of the fast idle air amount control system.

In this arrangement, since the bypass control valve 10 is disposed so that its axis Y is parallel to the axis B of the valve shaft $\mathbf{4}_1$ of the throttle valve $\mathbf{5}_1$ supported on the first throttle body $\mathbf{1}_1$, it is possible to arrange the valve shaft $\mathbf{4}_1$ and the bypass control valve 10 in proximity to each other, thus making the assembly of the first throttle body $\mathbf{1}_1$ and the bypass control valve 10 compact.

Furthermore, since the bypass control valve 10 is formed from the valve chamber 18 formed in the control block 15 joined to one side face of the first throttle body $\mathbf{1}_1$ and the valve body 26 housed in the valve chamber 18, the bypass 12 is formed so as to be divided between the first throttle body $\mathbf{1}_1$ and the control block 15, and it becomes easy to form the bypass 12. Moreover, since a subassembly of the control block 15 and the bypass control valve 10 can be assembled separately from the first throttle body $\mathbf{1}_1$ side, the ease of assembly is good, and since the control block 15 can be separated from the first throttle body $\mathbf{1}_1$, the ease of maintenance of the bypass control valve, etc. is good.

Furthermore, since the bypass control valve 10 and the electric actuator 25 are disposed between the first throttle body $\mathbf{1}_1$ and the cylinder head 40 of the front bank Ef, on which the first throttle body $\mathbf{1}_1$ is mounted, a dead space between the first throttle body $\mathbf{1}_1$ and the cylinder head 40 can be utilized effectively as a space for installing the bypass control valve 10 and the electric actuator 25, and it is possible to avoid interference of the bypass control valve 10 and the electric actuator 25 with other equipment.

Furthermore, since the first and second throttle body $\mathbf{1}_1$ and $\mathbf{1}_2$ are provided for each cylinder of the multicylinder engine E, it is possible to make the intake air of each cylinder uniform, thus contributing to an improvement of output performance of the engine E.

An embodiment of the present invention is explained above, but the present invention is not limited thereby and may be modified in a variety of ways as long as the modifications do not depart from the spirit and scope thereof.

The invention claimed is:

1. A fast idle air amount control system in a side stand-equipped two-wheeled motor vehicle, in which a bypass control valve (10) for controlling the amount of fast idle air supplied to an engine (E) mounted on a vehicle body is connected to a throttle body ($\mathbf{1}_1$) of the engine (E), and an actuator (25) for operating the bypass control valve (10) is coupled to the bypass control valve (10), characterized in that the bypass control valve (10) is arranged so that an axis (Y) of the bypass control valve (10) is substantially horizontal along the lateral direction of a two-wheeled motor vehicle (M) when the two-wheeled motor vehicle (M) is in an upright state and slopes downward toward a side stand (41) side when the two-wheeled motor vehicle (M) is put in an inclined parked state by standing the two-wheeled motor vehicle (M) on the side stand (41), and the actuator (25), which is electrically operated, is coupled to an end part of the bypass control valve (10) on a side opposite to the side stand (41).

2. The fast idle air amount control system in a side stand-equipped two-wheeled motor vehicle according to claim 1, wherein the bypass control valve (10) and the electrically operated actuator (25) are mounted on the throttle body ($\mathbf{1}_1$).

3. The fast idle air amount control system in a side stand-equipped two-wheeled motor vehicle according to claim 2, wherein the bypass control valve (10) is disposed so that the axis (Y) thereof is parallel to an axis (B) of a valve shaft ($\mathbf{4}_1$) of a throttle valve ($\mathbf{5}_1$) supported on the throttle body ($\mathbf{1}_1$).

4. The fast idle air amount control system in a side stand-equipped two-wheeled motor vehicle according to claim 2, wherein the bypass control valve (10) is formed from a valve chamber (18) formed in a control block (15) joined to one side face of the throttle body ($\mathbf{1}_1$) and a valve body (26) housed within the valve chamber (18).

5. The fast idle air amount control system in a side stand-equipped two-wheeled motor vehicle according to claim 1, wherein the bypass control valve (10) and the electrically operated actuator (25) are disposed between the throttle body ($\mathbf{1}_1$) and a cylinder head (40) of the engine (E) on which the throttle body ($\mathbf{1}_1$) is mounted.

6. The fast idle air amount control system in a side stand-equipped two-wheeled motor vehicle according to claim 1, wherein a throttle body ($\mathbf{1}_1$, $\mathbf{1}_2$) is provided for each cylinder of a multicylinder engine (E).

7. The fast idle air amount control system in a side stand-equipped two-wheeled motor vehicle according to claim 3, wherein the bypass control valve (10) is formed from a valve chamber (18) formed in a control block (15) joined to one side face of the throttle body ($\mathbf{1}_1$) and a valve body (26) housed within the valve chamber (18).

8. The fast idle air amount control system in a side stand-equipped two-wheeled motor vehicle according to claim 2, wherein the bypass control valve (10) and the electrically operated actuator (25) are disposed between the throttle body ($\mathbf{1}_1$) and a cylinder head (40) of the engine (E) on which the throttle body ($\mathbf{1}_1$) is mounted.

9. The fast idle air amount control system in a side stand-equipped two-wheeled motor vehicle according to claim 3, wherein the bypass control valve (10) and the electrically operated actuator (25) are disposed between the throttle body ($\mathbf{1}_1$) and a cylinder head (40) of the engine (E) on which the throttle body ($\mathbf{1}_1$) is mounted.

10. The fast idle air amount control system in a side stand-equipped two-wheeled motor vehicle according to claim 4, wherein the bypass control valve (10) and the electrically operated actuator (25) are disposed between the throttle body ($\mathbf{1}_1$) and a cylinder head (40) of the engine (E) on which the throttle body ($\mathbf{1}_1$) is mounted.

11. The fast idle air amount control system in a side stand-equipped two-wheeled motor vehicle according to claim 2, wherein a throttle body ($\mathbf{1}_1$, $\mathbf{1}_2$) is provided for each cylinder of a multicylinder engine (E).

12. The fast idle air amount control system in a side stand-equipped two-wheeled motor vehicle according to claim 3, wherein a throttle body ($\mathbf{1}_1$, $\mathbf{1}_2$) is provided for each cylinder of a multicylinder engine (E).

13. The fast idle air amount control system in a side stand-equipped two-wheeled motor vehicle according to claim 4, wherein a throttle body ($\mathbf{1}_1$, $\mathbf{1}_2$) is provided for each cylinder of a multicylinder engine (E).

14. The fast idle air amount control system in a side stand-equipped two-wheeled motor vehicle according to claim 5, wherein a throttle body ($\mathbf{1}_1$, $\mathbf{1}_2$) is provided for each cylinder of a multicylinder engine (E).

* * * * *